US011408120B2

(12) United States Patent
Castello

(10) Patent No.: US 11,408,120 B2
(45) Date of Patent: Aug. 9, 2022

(54) PORTABLE SHOWER GARMENT WASHER

(71) Applicant: Pat Anthony Castello, Anchorage, AK (US)

(72) Inventor: Pat Anthony Castello, Anchorage, AK (US)

( * ) Notice: Subject to any disclaimer, the term of this patent is extended or adjusted under 35 U.S.C. 154(b) by 59 days.

(21) Appl. No.: 17/093,634

(22) Filed: Nov. 10, 2020

(65) Prior Publication Data

US 2021/0269966 A1 Sep. 2, 2021

Related U.S. Application Data

(60) Provisional application No. 62/932,369, filed on Nov. 7, 2019.

(51) Int. Cl.

| | |
|---|---|
| ***D06F 95/00*** | (2006.01) |
| ***B05B 16/20*** | (2018.01) |
| ***D06F 39/08*** | (2006.01) |
| ***D06F 17/00*** | (2006.01) |
| ***D06F 17/04*** | (2006.01) |
| *D06F 58/14* | (2006.01) |

(52) U.S. Cl.

CPC ..... *D06F 95/00* (2013.01); *B05B 16/20* (2018.02); *D06F 17/00* (2013.01); *D06F 17/04* (2013.01); *D06F 39/08* (2013.01); *D06F 39/088* (2013.01); *D06F 58/14* (2013.01)

(58) Field of Classification Search

CPC . D06F 7/00; D06F 17/00; D06F 17/04; D06F 39/08; D06F 39/088; D06F 58/14; D06F 95/00; B05B 16/20

See application file for complete search history.

(56) References Cited

U.S. PATENT DOCUMENTS

| | | | | |
|---|---|---|---|---|
| 2,699,661 A * | 1/1955 | Olson | D06F 17/04 68/17 R |
| 3,418,832 A * | 12/1968 | Valdespino | D06F 17/04 68/183 |
| 3,683,651 A * | 8/1972 | Mazza | D06F 18/00 68/205 R |
| 2003/0126691 A1* | 7/2003 | Gerlach et al. | D06F 58/10 8/158 |
| 2009/0235464 A1* | 9/2009 | Cassidy | D06F 17/04 68/28 |

(Continued)

*Primary Examiner* — Joseph L. Perrin

(57) ABSTRACT

A portable shower garment washer is an apparatus that utilizes existing shower heads to wash garments. The apparatus includes frame assembly, an enclosure, and a washing mechanism. The frame assembly upholds the enclosure and the washing mechanism. The apparatus further includes a length-adjustable fastener that attaches the frame, and consequently the enclosure, with an existing shower head. The apparatus further includes a water supply, from an existing shower head, and the enclosure contains the water from the water supply, as well as soapy water, around the garments positioned within the enclosure. The washing mechanism provides a pre-rinse cycle, a pre-soak cycle, a rinse cycle and a drip cycle within the enclosure. The apparatus is preferably manually operated with valves but may also be automatically operated with actuators. The apparatus may further include a first inflatable bladder and a second inflatable bladder that squeeze the garments in order to facilitate drying.

20 Claims, 9 Drawing Sheets

(56) References Cited

U.S. PATENT DOCUMENTS

| | | | | |
|---|---|---|---|---|
| 2010/0251779 | A1* | 10/2010 | Zaglio | D06F 18/00 68/13 R |
| 2014/0026313 | A1* | 1/2014 | Zaglio | A47L 15/0097 68/12.02 |
| 2014/0076002 | A1* | 3/2014 | Kim | D06F 39/088 68/205 R |
| 2016/0230325 | A1* | 8/2016 | Dayan | D06F 57/00 |
| 2017/0292213 | A1* | 10/2017 | Lv | D06F 17/04 |
| 2019/0203395 | A1* | 7/2019 | Towner | D06F 89/00 |

* cited by examiner

PORTABLE SHOWER GARMENT WASHER

The current application claims a priority to the U.S. provisional patent application Ser. No. 62/932,369 filed on Nov. 7, 2019. The current application is filed on Nov. 9, 2020 while Nov. 7, 2020 was on a weekend.

FIELD OF THE INVENTION

The present invention generally relates to portable washers. More specifically, the present invention is a portable shower garment washer.

BACKGROUND OF THE INVENTION

Access to washing machines is not a luxury for many. Individuals that are traveling for leisure or for work may be staying in hotels or other lodgings that do not provide or offer free laundry services. Similarly, individuals that on road trips may also not be able to access laundromats. Miniature portable washers are an option. However, current miniature portable washers may be quite costly. Washing garments by hand may be much more cost effective but requires more time and effort to thoroughly wash.

It is therefore an objective of the present invention to provide a portable shower garment washer that may be engaged with a variety of showerheads. It is understood that the present invention may be engaged with a variety of other water sources. The present invention effectively washes garments, more specifically, multiple garments simultaneously. The present invention is easily assembled, cleaned, stored, and transported.

DETAIL DESCRIPTIONS OF THE INVENTION

Figure 1:
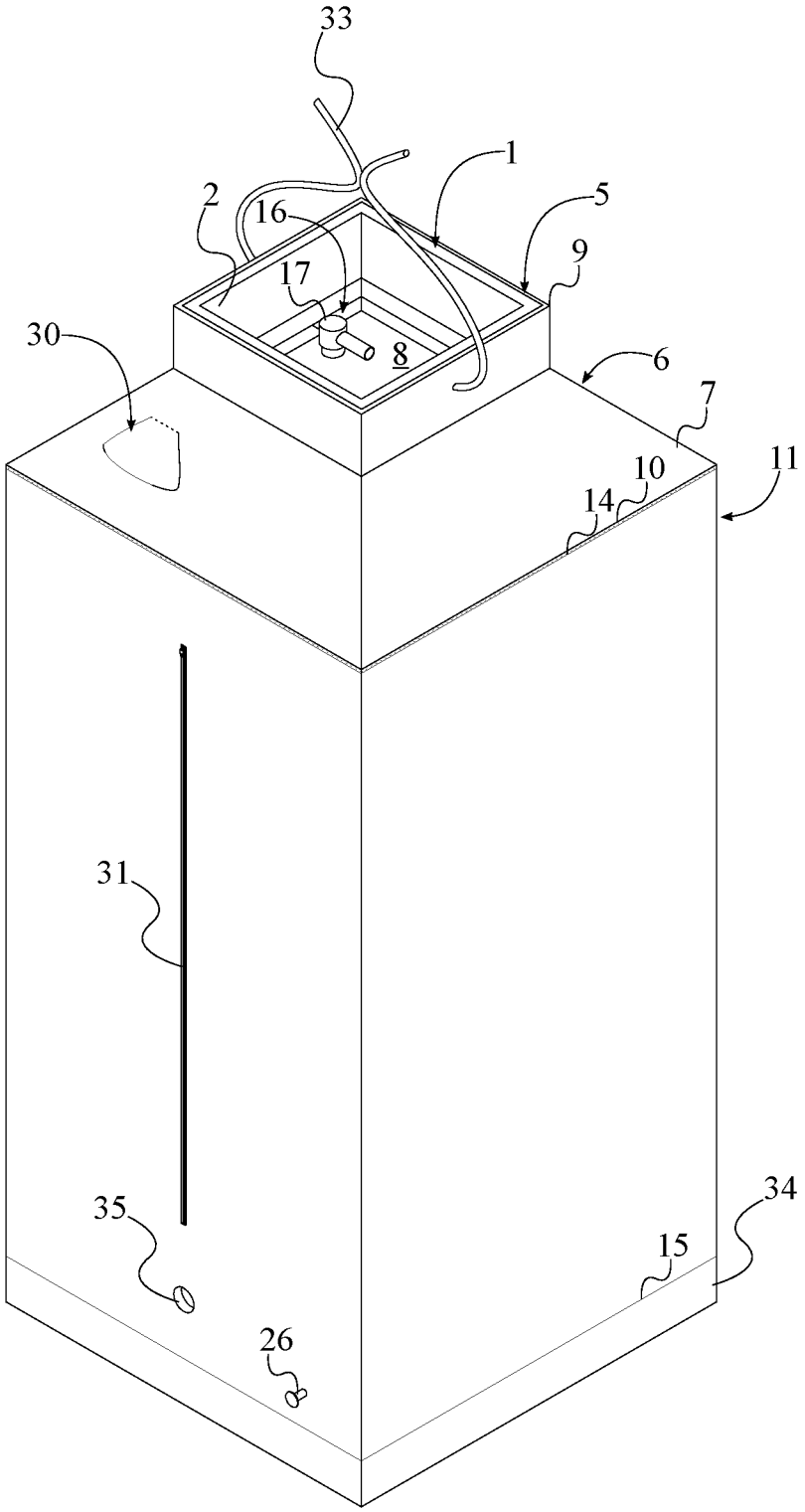
FIG. 1 is a perspective view of the present invention.

All illustrations of the drawings are for the purpose of describing selected versions of the present invention and are not intended to limit the scope of the present invention.

The present invention is portable shower garment washer that is easily assembled within a shower. The present invention utilizes an existing showerhead or comparable water source. The present invention a handsfree device that thoroughly washes garments simultaneously. The present invention serves as a quick and cost-effective solution for individuals who are in need of laundry services but are unable to easily access these services. In order for the present invention to be easily assembled within a shower, the present invention comprises a frame assembly 1, an enclosure 5, and a washing mechanism 16, seen in FIG. 1, FIG. 2, FIG. 3, and FIG. 4. The frame assembly 1 upholds and supports the enclosure 5, and consequently the washing mechanism 16. The frame defines a perimeter for the present invention in order for at least one garment to be effectively washed. The frame preferably comprises a rigid, structurally sound, and lightweight material. The weight of the present invention is evenly distributed around a showerhead as the frame assembly 1 comprises a reservoir frame 2 and an elongated clothing rod 3. The reservoir frame 2 expands the enclosure 5 around beneath a showerhead to that the weight of the present invention with the water collected within the enclosure 5 does place too much stress on the showerhead. The elongated clothing rod 3 not only supports the garments within the enclosure 5, but organizes the garments within the enclosure 5 with hangers, or the like, in order for the garments to be effectively washed. In the preferred embodiment of the present invention, the elongated clothing rod 3 is a stainless steel cross bar.

The enclosure 5 contains water and soapy water around the garments. The enclosure 5 is preferably a garment bag that is able to contain 2 to 3 gallons of water in order to limit the weight of the apparatus and the weight of the garments with the showerhead. The enclosure 5 houses and upholds the washing mechanism 16 and allows the washing mechanism 16 to complete multiple cycles. The enclosure 5 comprises an upper portion 6 and a lower portion 11. The upper portion 6 serves as a reservoir for the enclosure 5. The lower portion 11 comprises a front compartment 12 and a rear compartment 13, seen in FIG. 3, FIG. 4, FIG. 5, FIG. 6, FIG. 7, FIG. 8, and FIG. 9. The front compartment 12 contains the garments, and the rear compartment 13 shields parts of the washing mechanism 16 that are not able to withstand the forces of certain cycles, such as a soak cycle and a wash cycle.

The washing mechanism 16 provides the handsfree operations that effectively and thoroughly washes garments. The washing mechanism 16 comprises a pump valve 17, a first tubing 18, a main impeller 20, a water pump 21, a second tubing 22, a fill valve 24, a rear drain hole 25, and a front drain valve 26, seen in FIG. 3, FIG. 4, FIG. 5, and FIG. 6. The pump valve 17 opens and closes the water supply 27 for the water pump 21. The first tubing 18 defines a path of the water supply 27 directly from the upper portion 6 of the enclosure 5 to the water pump 21. The main impeller 20 directs water within the rear compartment 13 to the water pump 21. The water pump 21 outputs water and soapy water onto the garments with the second tubing 22. Alternate embodiments of the present invention may further comprise a vent hose at the top of the drive side for the main impeller 20. The fill valve 24 opens and closes water within the upper portion 6 with the front compartment 12. The rear drain opens and closes water and soapy water of the rear compartment 13. Similarly, the front drain valve 26 opens and closes water and soapy water of the front compartment 12. In the preferred embodiment of the present invention, the pump valve 17, the fill valve 24, and the front drain valve 26 are a plurality of manually-actuated valves. Alternate embodiments of the present invention may further comprise a float valve to prevent overflowing within the front compartment 12.

The overall configuration of the aforementioned components allows the present invention to serve as both a universal and portable washer unit. In order for a reservoir to be positioned above the garments and the garments to be rinsed before being washed, the reservoir frame 2 is positioned adjacent with the elongated clothing rod 3, seen in FIG. 1, FIG. 2, FIG. 3, and FIG. 4. The reservoir is defined as the upper portion 6 is attached around the reservoir frame 2, thereby containing water within the reservoir. The garments positioned within the lower portion 11 is washed within the enclosure 5 as the lower portion 11 is fixed adjacent with the upper portion 6. More specifically, the front compartment 12 is fixed adjacent with the rear compartment 13, and the rear compartment 13 is positioned across the front compartment 12. In order to protect the first tubing 18 and the impeller from pre-soak, the wash, and the rinse cycles, the first tubing 18 and the impeller is mounted within the rear compartment 13. The second tubing 22 and the water pump 21 is mounted within the front compartment 12 so that the garments may be thoroughly cleaned during the wash cycle. Moreover, the upper portion 6 is in fluid communication with the first tubing 18 through the pump valve 17 in order to control the output of water from the reservoir into the first tubing 18. An outlet 19 of the first tubing 18 is positioned adjacent to the impeller thereby supplying water for the water pump 21. In order for the water pump 21 to be automatically engaged by the natural water flow from the first tubing 18, the impeller is operatively coupled to the water pump 21, wherein rotation of the impeller is used to actuate the water pump 21. Water is directly supplied for the front compartment 12 as the upper portion 6 is in fluid communication with the front compartment 12 through the fill valve 24. Water is distributed above the garments hanging from the elongated clothing rod 3 as the pump is in fluid communication with the second tubing 22. More specifically, an outlet 23 of the second tubing 22 is positioned offset from the pump. In order to release water and soapy water from the front compartment 12, the front drain valve 26 is integrated into the front compartment 12, opposite the fill valve 24. Likewise, in order to release water and soapy water from the rear compartment 13, the rear drain is integrated into the rear compartment 13, opposite the drain valve.

The reservoir is defined with the upper portion 6 of the enclosure 5 as the upper portion 6 comprises a lateral panel 7, a base panel 8, a first rim 9, and a second rim 10, seen in FIG. 1, FIG. 2, FIG. 3, and FIG. 4. The lateral panel 7 surrounds and contains the water from a water source. The base panel 8 upholds the water and separates the water from the lower portion 11 until released by either the pump valve 17 or the fill valve 24. A depth of the reservoir is defined as the first rim 9 is positioned opposite the second rim 10 about the lateral panel 7. More specifically, the base panel 8 is positioned adjacent and across the second rim 10. In order to house water within the reservoir, the lateral panel 7 is perimetrically fixed around the base panel 8. The lower portion 11 is positioned beneath the upper portion 6 as the second rim 10 is perimetrically fixed around the lower portion 11. The pump valve 17 is integrated into the base panel 8 in order to secure the pump valve 17 within the enclosure 5. The rear compartment 13 is supplied with water through the base panel 8 as the pump valve 17 is positioned adjacent with the rear compartment 13. Likewise, the fill valve 24 is integrated into the base panel 8 in order to secure the fill valve 24 within the enclosure 5. The front compartment 12 is supplied with water through the base panel 8 as the fill valve 24 is positioned adjacent with the front compartment 12. The garments are pre-soaked and washed as the elongated clothing rod 3 is positioned within the front compartment 12, adjacent with the fill valve 24. In order to preserve the structural integrity of the present invention, the elongated clothing rod 3 is positioned parallel to the base panel 8 and is mounted offset from the base panel 8 by the reservoir frame 2. The outlet 23 of the second tubing 22 is positioned in between the base panel 8 and the elongated clothing rod 3 for the garments to be thoroughly washed. More specifically, the outlet 23 of the second tubing 22 is oriented towards the elongated clothing rod 3.

Figure 4:
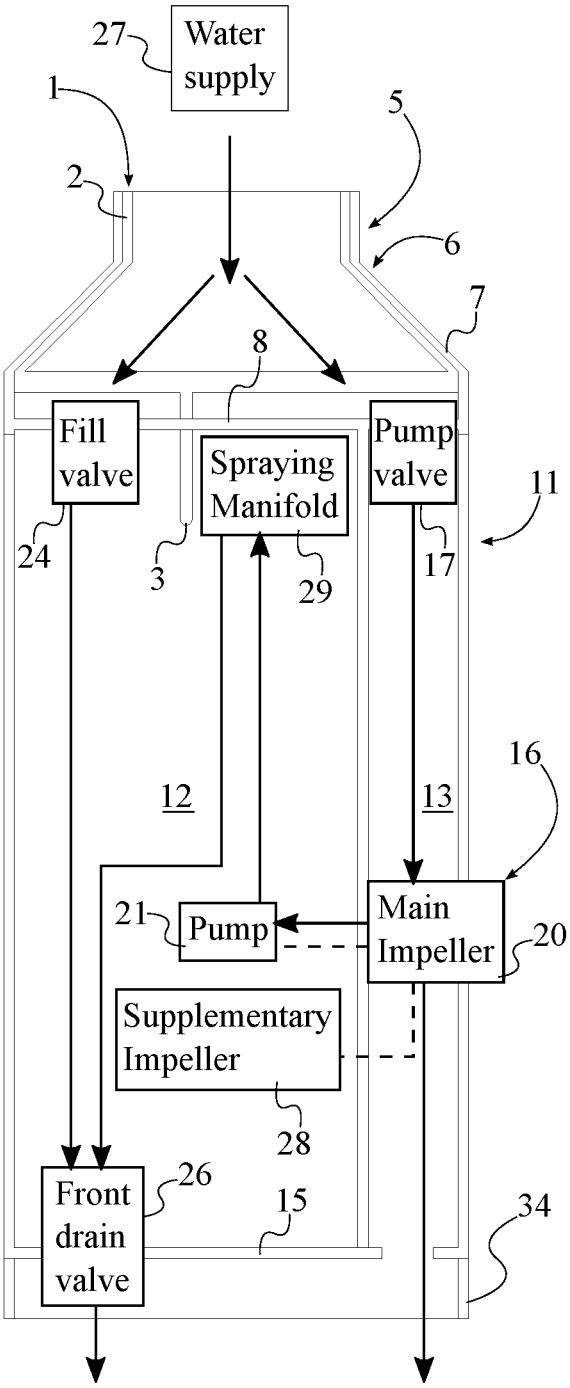
FIG. 4 is a flow chart of the water flow of the present invention.
Figure 5:
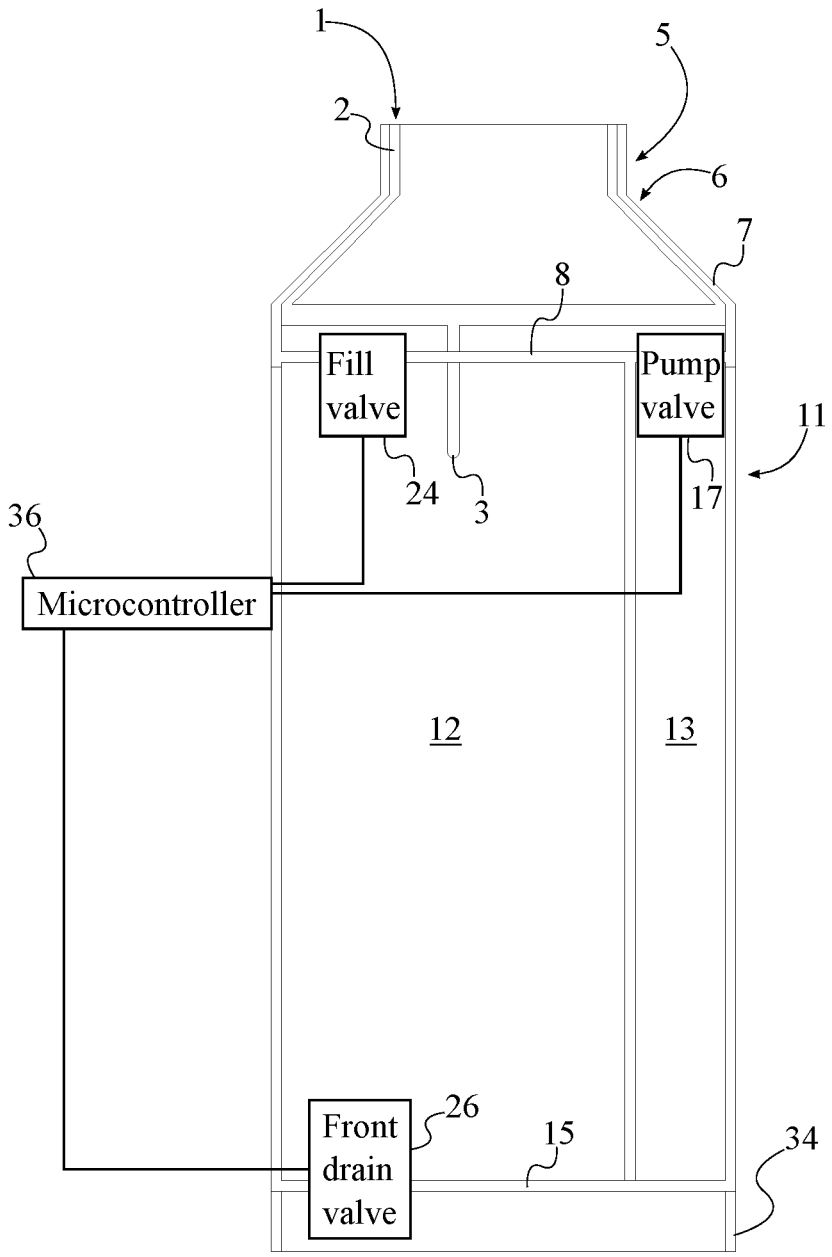
FIG. 5 is a schematic view of the electronic connection for a second embodiment of the present invention of the present invention.
Figure 6:
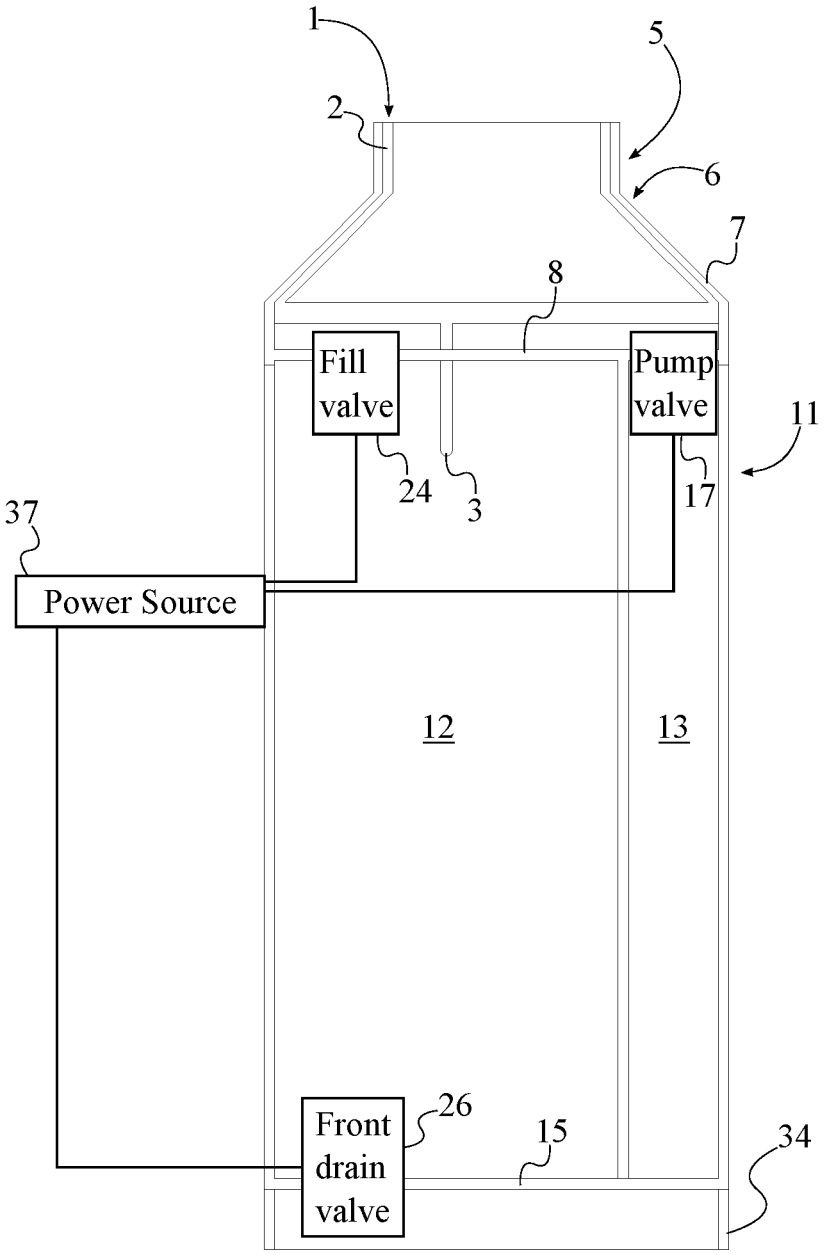
FIG. 6 is a schematic view of the electrical connections for the second embodiment of the present invention.
Figure 7:
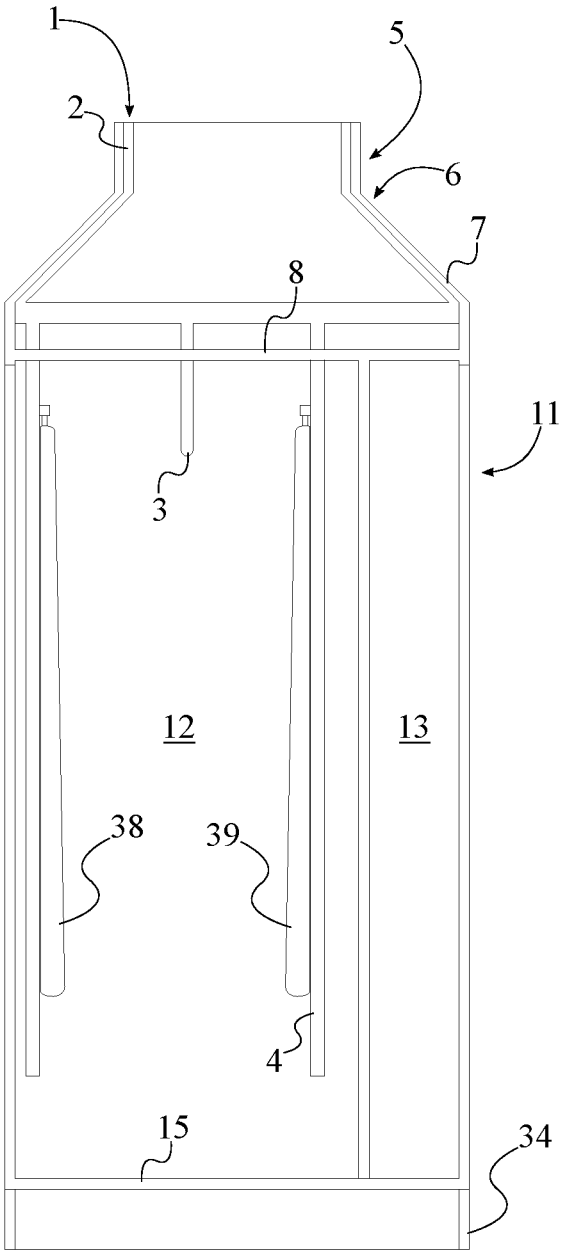
FIG. 7 is a schematic view of a first inflatable bladder, a second inflatable bladder, and a bladder frame of a third embodiment of the present invention.

In order to fill the enclosure 5 with water, wash garments, and rinse garments, the present invention further comprises a water supply 27, seen in FIG. 4. The water supply 27 is preferably a showerhead. The present invention performs the necessary cycles to thoroughly wash garments as the water supply 27 is positioned adjacent with the upper portion 6, opposite the lower portion 11. This arrangement therefore supplies the reservoir with water needed for the necessary cycles. More specifically, the water supply 27 is in fluid communication with the upper portion 6 through the first rim 9.

The garments are not only soaked with water and soapy water but thoroughly washed by circulating soapy water within the front compartment 12 which houses the garments. In order to circulate the soapy water and slightly agitate the garments, the present invention further comprises a supplementary impeller 28, seen in FIG. 3 and FIG. 4. The wash cycle is implemented with the supplementary impeller 28 as the supplementary impeller 28 is positioned within the front compartment 12, and the main impeller 20 is torsionally connected with the supplementary impeller 28. More specifically, the water pump 21 is positioned within the front compartment 12 and is mounted adjacent with the rear compartment 13. The water pump 21 preferably comprises a shield guard that shield the garments from getting snagged by the supplementary impeller 28. The shield guard is mounted with the water pump 21 and positioned offset with the supplementary impeller 28.

Figure 3:
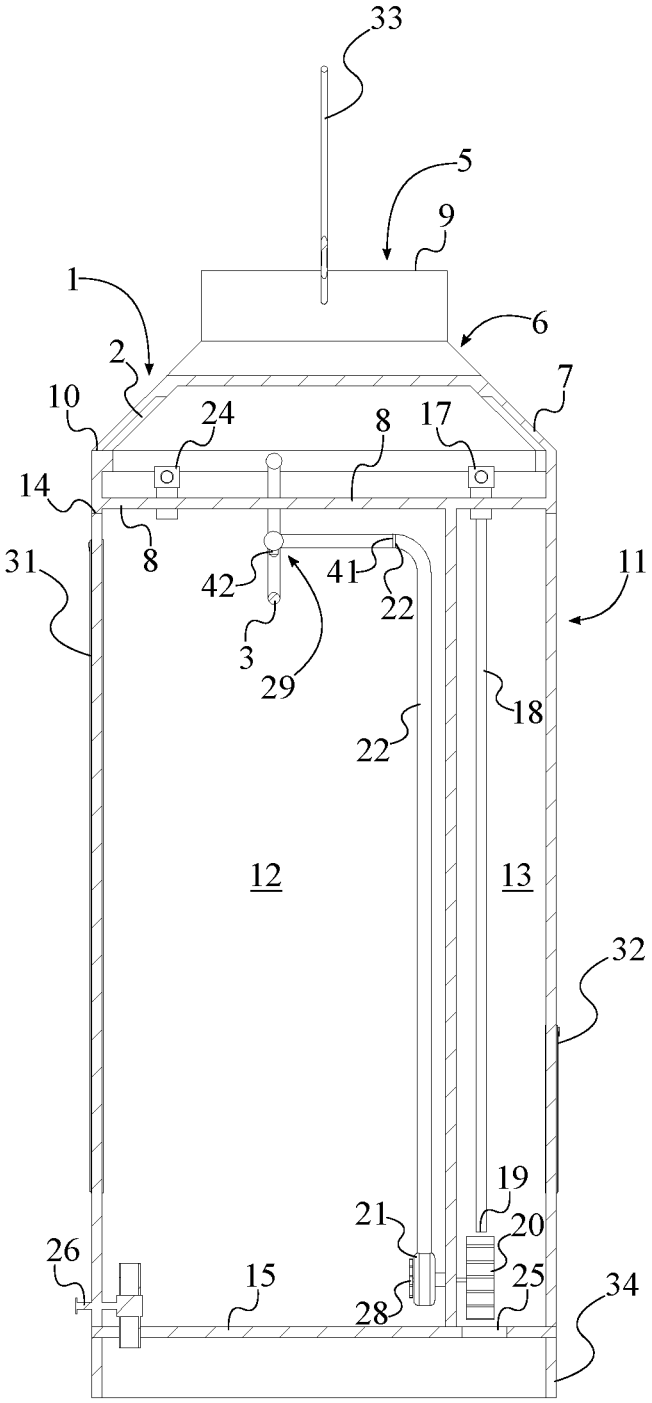
FIG. 3 is a cross-section view along line 3-3 of FIG. 2 of the present invention.

Each garment hanging along the elongated clothing rod 3 is equally rinsed as present invention comprises a spraying manifold 29, seen in FIG. 3. In order for the spraying manifold 29 to evenly dispense water across the elongated clothing rod 3, the spraying manifold 29 comprises a manifold inlet 41 and a plurality of manifold outlets 42. The manifold inlet 41 receives water from the water pump 21, and the plurality of manifold outlets 42 releases the water from the second tubing 22. The spraying manifold 29 evenly rinses the garments across the elongated clothing rod 3 with water as the plurality of manifold outlets 42 is oriented towards the elongated clothing rod 3. The spraying manifold 29 receives water from the second tubing 22 as the outlet 23 of the second tubing 22 is in fluid communication with the manifold inlet 41.

Figure 2:
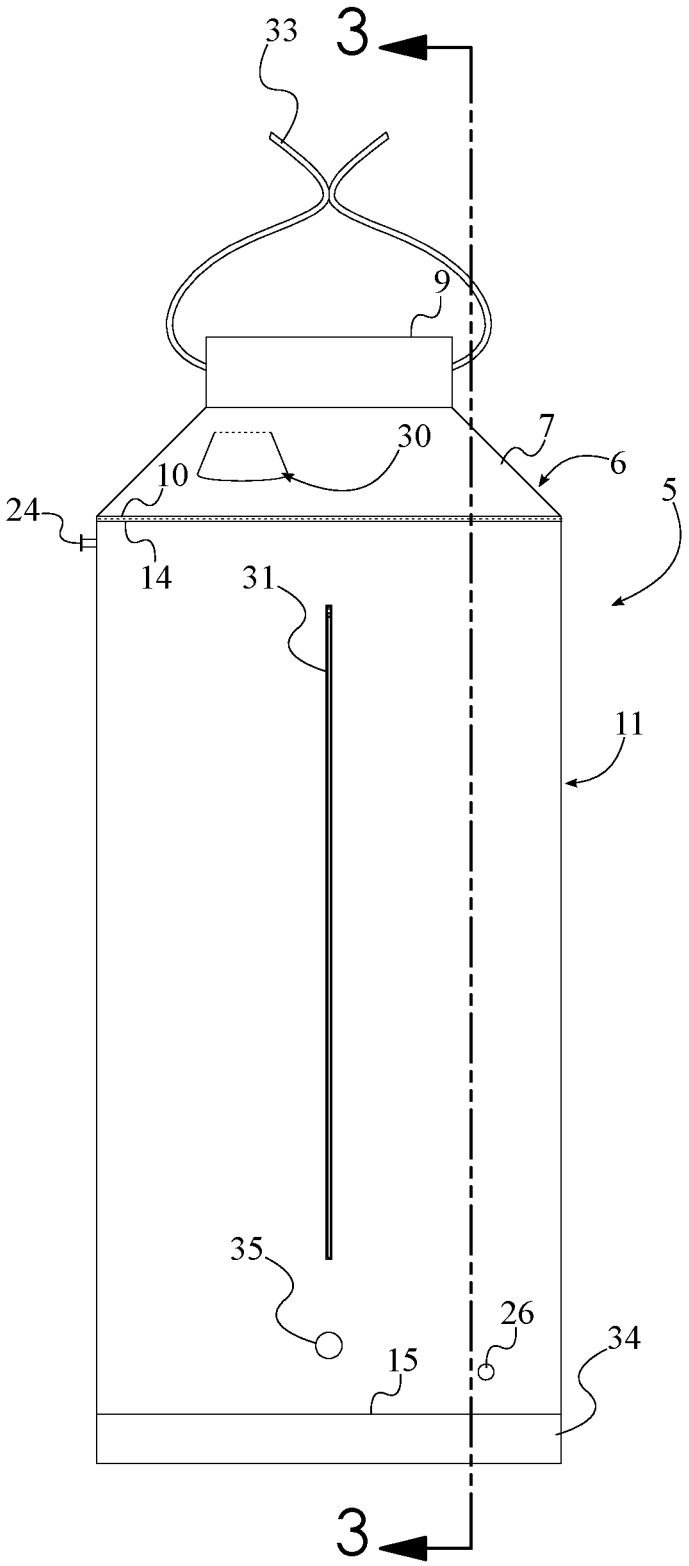
FIG. 2 is a front side view of the present invention.

In order to access the interior of the upper portion 6 of the enclosure 5, the present invention further comprises a door 30, seen in FIG. 1 and FIG. 2. In order to access the interior of the lower portion 11 of the enclosure 5, the present invention further comprises a first elongated fastening track and a second elongated fastening track. Soap may be added for the wash cycle as the door 30 is laterally integrated into the upper portion 6. The water within the reservoir is transformed into soapy water before being distributed through the enclosure 5 with the washing mechanism 16. Garments are positioned within the front compartment 12 as the first elongated fastening track is laterally integrated into the front compartment 12, opposite the rear compartment 13. The components of the washing mechanism 16 contained within the rear compartment 13 are accessible as the second elongated fastening track is laterally integrated into the rear compartment 13, opposite the front compartment 12. The elongated fastening track is preferably a water-sealed zipper.

The present invention further comprises a length-adjustable fastener 33, seen in FIG. 1, FIG. 2, and FIG. 3, so that the enclosure 5, and consequently the frame assembly 1, is safely suspended from a showerhead. The length-adjustable fastener 33 is preferably a drawstring that attaches around the showerhead. The length-adjustable fastener 33 is positioned adjacent with the upper portion 6, opposite the lower portion 11, so that the reservoir remains positioned above the garments while hanging from the showerhead. More specially, the length-adjustable fastener 33 is tethered with the upper portion 6 so that the enclosure 5, along with the frame assembly 1, may freely hang from the showerhead The present invention further comprises a lip 34 in order to direct the water towards a drain of a shower, seen in FIG. 1, FIG. 2, FIG. 3, FIG. 4, FIG. 5, FIG. 6, FIG. 7, FIG. 8, and FIG. 9. The lip 34 is positioned adjacent with the lower portion 11, opposite the upper portion 6. This arrangement shields the surrounding environment while allowing any water released from the rear drain hole 25 and the front drain valve 26 to fall into the drain of the shower. More specifically, the lip 34 is perimetrically fixed around the lower portion 11.

In order to facilitate the drying of the garments once the garments have been thoroughly washed, the present invention comprises a dryer hole 35, FIG. 1 and FIG. 2. The dryer hole 35 allows for a dryer unit, such as a hair dryer, to be adapted into the front compartment 12. The garments positioned within the front compartment 12 receive the heated air from a dryer unit as the dryer hole 35 traverses into the front compartment 12, opposite the rear compartment 13 and is positioned offset from the upper portion 6. It is understood that an adapter may be required in order to connect the dryer unit into the dryer hole 35, and a seal is engaged with the dryer hole 35 while not in use.

A second embodiment of the present invention allows the pump valve 17, the fill valve 24, the rear drain hole 25, and the front drain valve 26 to be automatically controlled, whereas the preferred embodiment of the present invention requires manual adjustment. The second embodiment of the present invention comprises a microcontroller 36 and a power source 37, seen in FIG. 5 and FIG. 6. The microcontroller 36 manages the operations of the pump valve 17, the fill valve 24, and the front drain valve 26. The power source 37 provides the necessary power for the pump valve 17, the fill valve 24, and the front drain valve 26. The power source 37 is preferably a replaceable battery but may also be a rechargeable battery that is connected with a power cord. The pump valve 17, the fill valve 24, and the front drain valve 26 are a plurality of electronically-actuated solenoid vales. More specifically, for the second embodiment of the present invention, each electronically-actuated solenoid valve is a 15 watt direct current (DC) solenoid valve that may be remotely controlled with a DC controller. In order for the microcontroller 36 to operate the first solenoid actuator, the second solenoid actuator, and the third solenoid actuator the microcontroller 36 is electronically connected with the first solenoid actuator, the second solenoid actuator, and the third solenoid actuator. In order for the power source 37 to supply power for the first solenoid actuator, the second solenoid actuator, and the third solenoid actuator, the power source 37 is electrically connected with the first solenoid actuator, the second solenoid actuator, and the third solenoid actuator. The pump valve 17 is remotely controlled as the first solenoid actuator is operatively coupled with the pump valve 17, wherein the first solenoid actuator is used to open and close the pump valve 17. The fill valve 24 is remotely controlled as the second solenoid actuator is operatively coupled with the fill valve 24, wherein the second solenoid actuator is used to open and close the fill valve 24. The front drain valve 26 is remotely controlled as the third solenoid actuator is operatively coupled with the front drain valve 26, wherein the third solenoid actuator is used to open and close the front drain valve 26.

A third embodiment of the present invention facilitates the drying of the garments within the enclosure 5 and provides the means to do so. The third embodiment of the present invention comprises a first inflatable bladder 38, a second inflatable bladder 39, a compressor 40, a microcontroller 36, and a power source 37, seen in FIG. 7, FIG. 8, and FIG. 9. The first inflatable bladder 38 and the second inflatable bladder 39 squeeze any excess water from the garments upon the completion of cycles with the washing mechanism 16. In order to support and contain the inflatable bladders, the frame further comprises a bladder frame 4. The bladder frame 4 prevents the first inflatable bladder 38 and the second inflatable bladder 39 from extending outwards towards the enclosure 5, but rather inwards, towards the garments. The compressor 40 automatically fills the first inflatable bladder 38 and the second inflatable bladder 39 with air until the first inflatable bladder 38 and the second inflatable bladder 39 fully inflate and squeeze the garments positioned in between. It is understood that the microcontroller 36 and the power source 37 of the fourth embodiment are the same electronic units disclosed for the second embodiment of the present invention. As the garments are positioned within the front compartment 12, the bladder frame 4 is positioned within the front compartment 12 and is mounted offset from the upper portion 6 by the reservoir frame 2. Furthermore, the first inflatable bladder 38 and the second inflatable bladder 39 are positioned within the bladder frame 4. The clothes are positioned in between the first inflatable bladder 38 and the second inflatable bladder 39 as the first inflatable bladder 38 is positioned opposite the second inflatable bladder 39 about the bladder frame 4.

Figure 8:
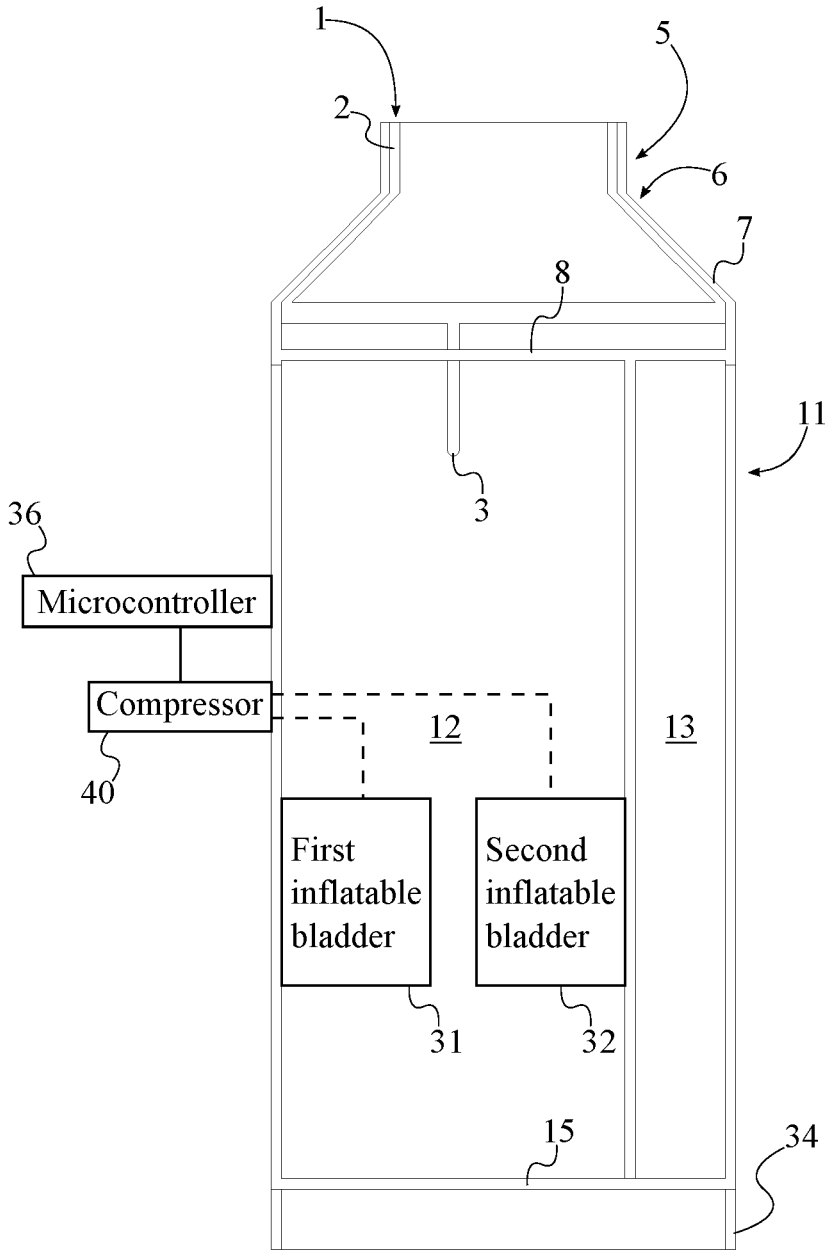
FIG. 8 is a schematic view of the electronic connections for a third embodiment of the present invention.
Figure 9:
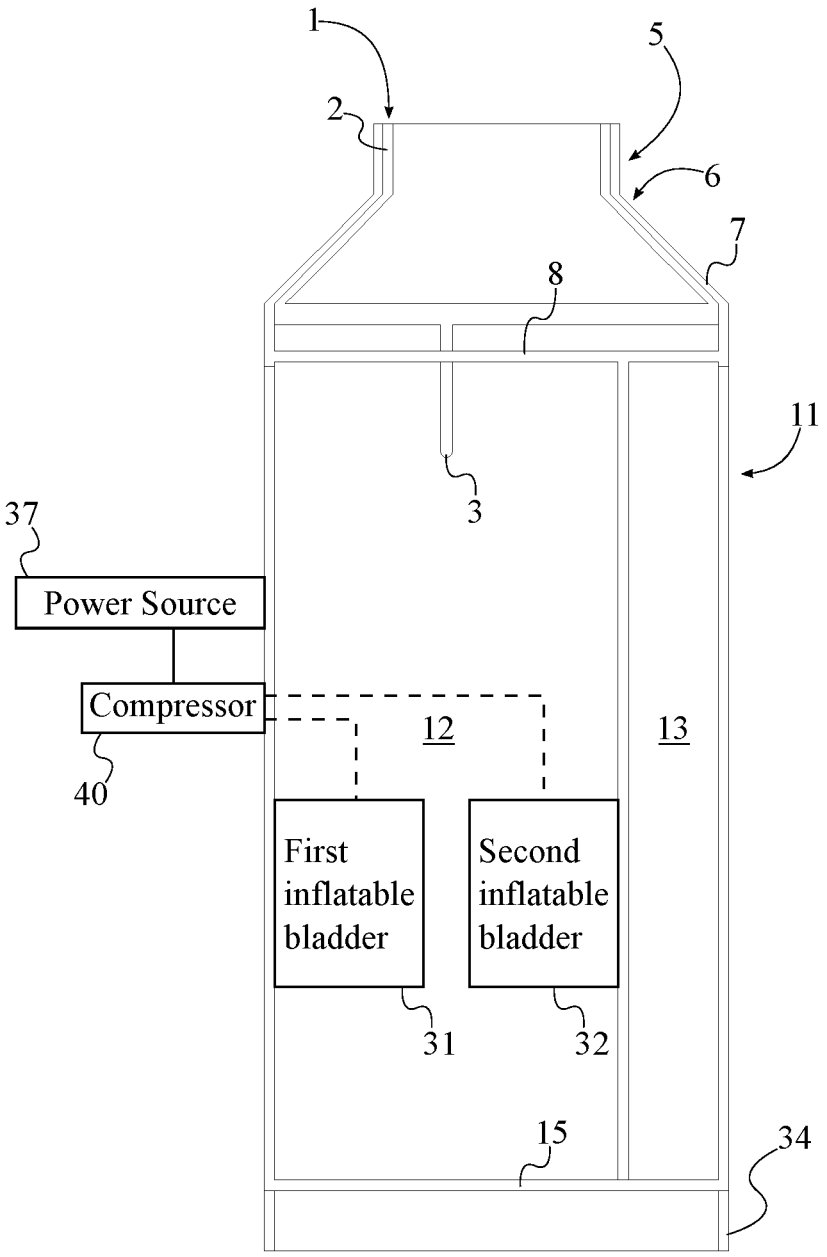
FIG. 9 is a schematic view of the electrical connections for the third embodiment of the present invention.

In order to remotely operate the compressor 40, the microcontroller 36 is electronically connected with the compressor 40, seen in FIG. 8 and FIG. 9. The power source 37 supplies the compressor 40 with necessary power as the power source 37 is electrically connected with the compressor 40. In order to automatically inflate the first inflatable bladder 38, the compressor 40 is operatively coupled with the first inflatable bladder 38, wherein the compressor 40 is used to adjust an internal pressure of the first inflatable bladder 38. In order to automatically inflate the second inflatable bladder 39, the compressor 40 is operatively coupled with the second inflatable bladder 39, wherein the compressor 40 is used to adjust an internal pressure of the second inflatable bladder 39. Further embodiments of the present invention may further compromise a pressure relief valve, pressure switch, and a timer with a delay.

In further embodiments of the present invention, the present invention is collapsible, thereby facilitating storage and transport. In these further embodiments of the present invention, the upper portion 6 comprises a first rim 9 and a second rim 10. The first rim 9 is positioned around the showerhead. The second rim 10 connects the upper portion 6 with the lower portion 11. The lower portion 11 comprises a third rim 14 and a fourth rim 15. The third rim 14 connects the lower portion 11 with the upper portion 6. The fourth rim 15 surrounds a base of both the front compartment 12 and the rear compartment 13. The first rim 9 is positioned opposite the second rim 10 about the upper portion 6, thereby defining the depth for the reservoir. The third rim 14 is positioned opposite the fourth rim 15 about the lower portion 11, thereby defining a depth for the front compartment 12, which serves as the washing chamber, and consequently the rear compartment 13. The lower portion 11 is suspended with the upper portion 6 as the second rim 10 is perimetrically fixed with the third rim 14. The present invention is collapsible as the reservoir frame 2 is flexible and/or telescopic, and the first tubing 18, the second tubing 22, and the enclosure 5 are flexible. However, the first tubing 18, the second tubing 22, and the enclosure 5 may alternatively be telescopic. Wherein the frame assembly 1, the enclosure 5, and the washing mechanism 16 are in an operative configuration, the first rim 9 is positioned opposite to the fourth rim 15 about the enclosure 5. The operative configuration provides the space for the washing mechanism 16 to properly operate, the reservoir and the front compartment 12 to fill with water, and garments to be positioned within the front compartment 12. More specifically, the second rim 10 and the third rim 14 are positioned in between the first rim 9 and the fourth rim 15. This arrangement fully extends the enclosure 5. Wherein the frame assembly 1, the enclosure 5, and the washing mechanism 16 are in a collapsed configuration, the first rim 9, the second rim 10, the third rim 14, and the fourth rim 15 are positioned coincident to each other. The collapsed configuration compresses the frame assembly 1, the enclosure 5, and the washing mechanism 16 to minimize the amount of space occupied by the present invention while not in use. This arrangement fully retracts the enclosure 5.

The present invention is utilized to perform a series of cycles which thoroughly washes garments by first attaching the present invention to a showerhead with the length-adjustable fastener 33. The enclosure 5, and consequently the frame assembly 1, suspends from the showerhead. The elongated fastening track is disengaged to open the front compartment 12, and clothing is hung from the elongated clothing rod 3 with hangers. The elongated fastening track is reengaged to close and seal the front compartment 12. In order to achieve the desired temperature, the pump valve 17 is opened, and the rear drain hole 25 is opened until the water temperature has been successfully adjusted. More specifically, the fill valve 24 is closed and the front drain valve 26 is closed. In order to rinse the garments and get the garments soaked before being washed with soap, the fill valve 24 is opened, and the front drain valve 26 is opened. More specifically, the pump valve 17 is closed. This allows garments to get soaked with water and provides the time to adjust the water temperature with the shower. Once the clothes are thoroughly soaked. The front drain valve 26 is closed allowing the front compartment 12 to fill with water. The fill valve 24 is then closed, and the pump valve 17 is opened. Soap is added into the reservoir through the door 30. The washing mechanism 16 proceeds with the wash cycle as water is pumped into the second tubing 22, outputted by the spraying manifold 29, and the supplementary impeller 28 is rotatably engaged with the main impeller 20. The main impeller 20 is engaged as water is supplied to the rear compartment 13 through the pump valve 17 and released through the rear drain hole 25. This prevents the front compartment 12 from overflowing, while maintaining the engagement of the main impeller 20. Upon the completion of the wash cycle, the clothes are rinsed during the rinse cycle. The rinse cycle begins with the opening of the front drain valve 26, releasing soapy water out from the enclosure 5 and into a shower drain. Water from the shower head rinses the garments as the pump valve 17 is opened and water is forced through the first tubing 18, the pump, the second tubing 22, and the spraying manifold 29. If additional rinsing is needed, the front compartment 12 may be filled again with water from the shower head by closing the front drain valve 26 until the front compartment 12 is rinsed of soapy water, then opening the front drain valve 26 once again. In order to dry the present invention itself, the showerhead is closed, and both the front drain valve 26 is opened, and the rear drain hole 25 is open, to let any leftover water along the inner surfaces of the enclosure 5 to fall out. Furthermore, if the outer surfaces of the enclosure 5 need to be cleaned, hot water from the shower head may overflow from the first rim 9 of the upper portion 6 by closing both the pump valve 17 and the fill valve 24.

Although the invention has been explained in relation to its preferred embodiment, it is to be understood that many other possible modifications and variations can be made without departing from the spirit and scope of the invention as hereinafter claimed.

What is claimed is:

1. A portable shower garment washer comprises:

a frame assembly;

an enclosure;

a washing mechanism;

a length-adjustable fastener that attaches the frame assembly to an existing shower head;

a water supply that supplies the washing mechanism with water;

a spraying manifold that dispenses water from the washing mechanism;

the frame assembly comprises a reservoir frame and an elongated clothing rod;

the enclosure comprises an upper portion and a lower portion;

the lower portion comprises a front compartment and a rear compartment;

the washing mechanism comprises a pump valve, a first tubing, a main impeller, a water pump, a second tubing, a fill valve, a rear drain hole, and a front drain valve;

the reservoir frame being positioned adjacent with the elongated clothing rod;

the upper portion being attached around the reservoir frame;

the lower portion being fixed adjacent with the upper portion;

the front compartment being fixed adjacent with the rear compartment;

the rear compartment being positioned across the front compartment;

the first tubing and the impeller being mounted within the rear compartment;

the second tubing and the water pump being mounted within the front compartment;

the upper portion being in fluid communication with the first tubing through the pump valve;

an outlet of the first tubing being positioned adjacent to the impeller;

the impeller being operatively coupled to the water pump, wherein rotation of the impeller is used to actuate the water pump;

the upper portion being in fluid communication with the front compartment through the fill valve;

the pump being in fluid communication with the second tubing;

an outlet of the second tubing being positioned offset from the pump;

the front drain valve being integrated into the front compartment, opposite the fill valve; and, the rear drain hole being integrated into the rear compartment, opposite the drain valve.

2. The portable shower garment washer as claimed in claim 1 comprises:

the upper portion comprises a lateral panel, a base panel, a first rim, and a second rim;

the first rim being positioned opposite the second rim about the lateral panel;

the base panel being positioned adjacent and across the second rim;

the lateral panel being perimetrically fixed around the base panel; and, the second rim being perimetrically fixed around the lower portion.

3. The portable shower garment washer as claimed in claim 2 comprises:

the pump valve being integrated into the base panel; and, the pump valve being positioned adjacent with the rear compartment.

4. The portable shower garment washer as claimed in claim 2 comprises:

the water supply being positioned adjacent the upper portion, opposite the lower portion; and, the water supply being in fluid communication with the upper portion through the first rim.

5. The portable shower garment washer as claimed in claim 4, wherein the water supply is a showerhead.

6. The portable shower garment washer as claimed in claim 2 comprises:

the fill valve being integrated into the base panel;

the fill valve being positioned adjacent with the front compartment;

the elongated clothing rod being positioned within the front compartment, adjacent with the fill valve;

the elongated clothing rod being positioned parallel to the base panel;

the elongated clothing rod being mounted offset from the base panel by the reservoir frame;

the outlet of the second tubing being positioned in between the base panel and the elongated clothing rod; and, the outlet of the second tubing being oriented towards the elongated clothing rod.

7. The portable shower garment washer as claimed in claim 1 comprises:

a supplementary impeller;

the supplementary impeller being positioned within the front compartment; and, the main impeller being torsionally connected with the supplementary impeller.

8. The portable shower garment washer as claimed in claim 1 comprises:

the water pump being positioned within the front compartment; and, the water pump being mounted adjacent with the rear compartment.

9. The portable shower garment washer as claimed in claim 1 comprises:

the spraying manifold comprises a manifold inlet and a plurality of manifold outlets;

the plurality of manifold outlets being oriented towards the elongated clothing rod; and, the outlet of the second tubing being in fluid communication with the manifold inlet.

10. The portable shower garment washer as claimed in claim 1 comprises:

a door; and, a door being laterally integrated into the upper portion.

11. The portable shower garment washer as claimed in claim 1 comprises:

a first elongated fastening track;

a second elongated fastening track;

the first elongated fastening track being laterally integrated into the front compartment, opposite the rear compartment; and the second elongated fastening track being laterally integrated into the rear compartment, opposite the front compartment.

12. The portable shower garment washer as claimed in claim 1 comprises:

the length-adjustable fastener being positioned adjacent with the upper portion, opposite the lower portion; and, the length-adjustable fastener being tethered with the upper portion.

13. The portable shower garment washer as claimed in claim 1 comprises:

a lip;

the lip being positioned adjacent with the lower portion, opposite the upper portion; and, the lip being perimetrically fixed around the lower portion.

14. The portable shower garment washer as claimed in claim 1 comprises:

a dryer hole;

the dryer hole traversing into the front compartment, opposite the rear compartment; and, the dryer hole being positioned offset from the upper portion.

15. The portable shower garment washer as claimed in claim 1, wherein the pump valve, the fill valve, and the front drain valve are a plurality of manually-actuated valves.

16. The portable shower garment washer as claimed in claim 1 comprises:

a microcontroller;

a power source;

the pump valve, the fill valve, and the front drain valve being a plurality of electronically-actuated solenoid valves;

the microcontroller being electronically connected with the pump valve, the fill valve, and the front drain valve; and the power source being electrically connected with the pump valve, the fill valve, and the front drain valve.

17. The portable shower garment washer as claimed in claim 1 comprises:

a first inflatable bladder;

a second inflatable bladder;

a compressor;

a microcontroller;

a power source;

the frame assembly further comprises a bladder frame;

the bladder frame being positioned within the front compartment;

the bladder frame being mounted offset from the upper portion by the reservoir frame;

the first inflatable bladder and the second inflatable bladder being positioned within the bladder frame;

the first inflatable bladder being positioned opposite the second inflatable bladder about the bladder frame;

the microcontroller being electronically connected with the compressor;

the power source being electrically connected with the compressor;

the compressor being operatively coupled with the first inflatable bladder, wherein the compressor is used to adjust an internal pressure of the first inflatable bladder; and, the compressor being operatively coupled with the second inflatable bladder, wherein the compressor is used to adjust an internal pressure of the second inflatable bladder.

18. The portable shower garment washer as claimed in claim 1 comprises:

the upper portion comprises a first rim and a second rim;

the lower portion comprises a third rim and a fourth rim;

the first rim being positioned opposite the second rim about the upper portion;

the third rim being positioned opposite the fourth rim about the lower portion;

the second rim being perimetrically fixed with the third rim;

the reservoir frame being flexible; and, the first tubing, the second tubing, and the enclosure being flexible.

19. The portable shower garment washer as claimed in claim 18 comprises:

wherein the frame assembly, the enclosure, and the washing mechanism are in an operative configuration;

the first rim being positioned opposite to the fourth rim about the enclosure; and, the second rim and the third rim being positioned in between the first rim and the fourth rim.

20. The portable shower garment washer as claimed in claim 19 comprises:

wherein the frame assembly, the enclosure, and the washing mechanism are in a collapsed configuration; and, the first rim, the second rim, the third rim, and the fourth rim being positioned coincident to each other.

* * * * *